US009964899B2

(12) United States Patent
Sato

(10) Patent No.: US 9,964,899 B2
(45) Date of Patent: May 8, 2018

(54) DESTATICIZING DEVICE FOR DESTATICIZING A RECORDING MEDIUM, AND IMAGE FORMING APPARATUS THEREWITH

(71) Applicant: KYOCERA Document Solutions Inc., Osaka (JP)

(72) Inventor: Takehiro Sato, Osaka (JP)

(73) Assignee: KYOCERA Document Solutions, Osaka (JP)

( * ) Notice: Subject to any disclaimer, the term of this patent is extended or adjusted under 35 U.S.C. 154(b) by 0 days. days.

(21) Appl. No.: 15/487,002

(22) Filed: Apr. 13, 2017

(65) Prior Publication Data

US 2017/0299988 A1 Oct. 19, 2017

(30) Foreign Application Priority Data

Apr. 15, 2016 (JP) ..... 2016-081719

(51) Int. Cl.
*G03G 15/16* (2006.01)

(52) U.S. Cl.
CPC ..... *G03G 15/1665* (2013.01)

(58) Field of Classification Search
CPC ..... G03G 15/1665
USPC ..... 399/314
See application file for complete search history.

(56) References Cited

U.S. PATENT DOCUMENTS

2016/0124352 A1* 5/2016 Kanai ..... G03G 15/1665 399/315

FOREIGN PATENT DOCUMENTS

JP 2009-229943 A 10/2009

* cited by examiner

*Primary Examiner* — Billy Lactaoen
(74) *Attorney, Agent, or Firm* — Stein IP, LLC

(57) ABSTRACT

A destaticizing device has a destaticizing member, a holding member, and a body portion. The destaticizing member has a plurality of destaticizing needless. The holding member holds the destaticizing member. The body portion has the holding member removably attached to it. The destaticizing member has attachment holes for attachment to the holding member. The holding member has a plurality of bosses inserted in the attachment holes respectively and an engaging portion in a snap-fit shape for attachment to the body portion. The body portion has an engaged portion with which the engaging portion is engaged.

3 Claims, 4 Drawing Sheets

DESTATICIZING DEVICE FOR DESTATICIZING A RECORDING MEDIUM, AND IMAGE FORMING APPARATUS THEREWITH

INCORPORATION BY REFERENCE

This application is based upon and claims the benefit of priority from the corresponding Japanese Patent Application No. 2016-081719 filed on Apr. 15, 2016, the entire contents of which are incorporated herein by reference.

BACKGROUND

The present disclosure relates to a destaticizing device and an image forming apparatus incorporating one. More particularly, the present disclosure relates to a destaticizing device including a destaticizing member with a plurality of destaticizing needles and a holding member for holding the destaticizing member, and to an image forming apparatus incorporating such a destaticizing device.

Conventionally, in an electrophotographic image forming apparatus, a toner image is carried on the surface of an image carrier such as a photosensitive drum, an intermediary transfer belt, or the like; then the toner image carried on the surface of the image carrier is transferred to a recording medium; then the recording medium is cleared of static electricity by a destaticizing device so as to be separated from the surface of the image carrier; then the recording medium separated from the image carrier is fed into a fixing device; then the toner image is fixed to the recording medium by the fixing device; and then the recording medium is conveyed to a discharge tray or the like.

For example, one known destaticizing device includes a destaticizing member which has a plurality of destaticizing needles protruding toward the recording medium, a holding member which holds the destaticizing member, and a body portion to which the holding member is attached. Typically, the destaticizing member is stuck to the holding member with double-sided tape or the like to suppress undulation (sag), and the holding member is secured to the body portion with screws. When a voltage is applied to the destaticizing member, a discharge current passes from the destaticizing needles to the recording medium that has passed across the image carrier; the recording medium is thus destaticized and is separated from the image carrier.

SUMMARY

A destaticizing device according to one aspect of the present disclosure is for destaticizing a recording medium that has passed through a transfer nip portion formed by an image carrier that carries a toner image and a transferring member that lies in contact with the image carrier. The destaticizing device includes a destaticizing member, a holding member, and a body portion. The destaticizing member is arranged to face the side of the recording medium opposite from its side to which the toner image is transferred, and has a plurality of destaticizing needles protruding toward the recording medium. The holding member holds the destaticizing member. The body portion has the holding member removably attached to it downstream of the destaticizing member in the recording medium conveying direction. The destaticizing member has a plurality of attachment holes for attachment to the holding member. The holding member has a plurality of bosses inserted in the plurality of attachment holes respectively and an engaging claw in a snap-fit shape for attachment to the body portion. The body portion has an engaged portion with which the engaging claw is engaged.

Further features and advantages of the present disclosure will become apparent from the description of embodiments given below.

DETAILED DESCRIPTION

An embodiment of the present disclosure will be described below with reference to the accompanying drawings.

Figure 1:
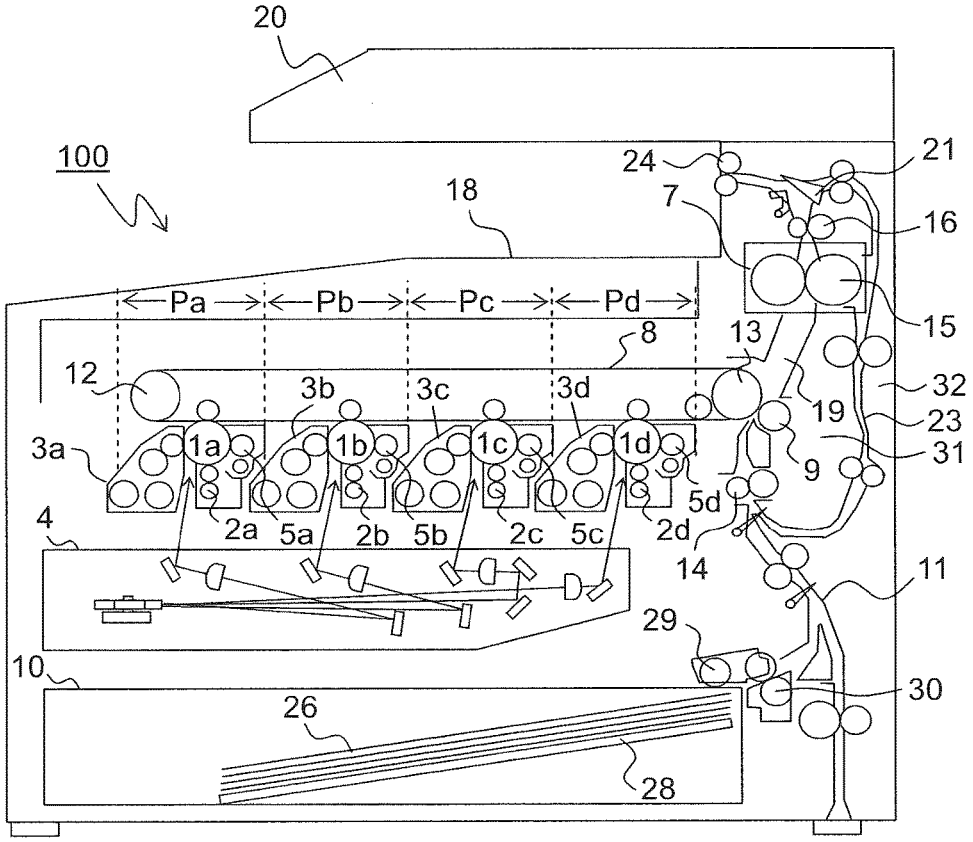
FIG. 1 is a sectional view showing an overall structure of an image forming apparatus incorporating a destaticizing device according to one embodiment of the present disclosure.

With reference to FIGS. 1 to 7, an image forming apparatus 100 incorporating a destaticizing device 40 (see FIG. 2) according to one embodiment of the present disclosure will be described. As shown in FIG. 1, the image forming apparatus 100 is a tandem-type color copier, and inside the main body of the image forming apparatus 100, four image forming sections Pa, Pb, Pc, and Pd are arranged from left to right in FIG. 1. The image forming sections Pa to Pd are provided to correspond to four different colors (yellow, magenta, cyan, and black), and form yellow, magenta, cyan, and black images successively each through the process of charging, exposure, development, and transfer.

In these image forming sections Pa to Pd, photosensitive drums 1*a*, 1*b*, 1*c*, and 1*d* that carry visible images (toner images) of the different colors are arranged, and an intermediary transfer belt (image carrier) 8 that rotates counterclockwise in FIG. 1 is provided next to the these image forming sections Pa to Pd. The toner images formed on these photosensitive drums 1*a* to 1*d* are successively transferred to the intermediary transfer belt 8, which moves while in contact with the photosensitive drums 1*a* to 1*d*, so as to be superimposed on each other, and are then transferred, by the action of a secondary transfer roller (transferring member) 9, to a sheet 26 as one example of a recording medium, and are then fixed to the sheet 26 in a fixing device 7, the sheet then being discharged out of the apparatus main body. While the photosensitive drums 1*a* to 1*d* are rotated clockwise in FIG. 1, an image forming process is performed with respect to the photosensitive drums 1*a* to 1*d*.

Sheets 26 to which toner images are to be transferred are stored in a sheet feed cassette 10 in a lower part of the apparatus. The sheets 26 are stacked on a sheet stack plate 28 in the sheet feed cassette 10, and when a pickup roller 29 is rotated with the top face of the sheets 26 in pressed contact with the pickup roller 29 under a predetermined pressure, the sheets 26 start to be fed out. Then, only the topmost one of the plurality of sheets 26 is separated by a pair of conveying rollers 30, and is conveyed toward a sheet conveying passage 11. The sheet 26 conveyed by the pair of conveying rollers 30 and having passed through the sheet conveying passage 11 reaches a pair of registration rollers 14, and is conveyed, synchronously with the timing of image formation, to a nip portion between the secondary transfer roller 9 and a driving roller 13 of the intermediary transfer belt 8.

For the intermediary transfer belt 8, a sheet of a dielectric resin is used, which typically is a belt with no seam (a seamless belt).

An image reading section 20 reads a document image and converts it into image data.

Next, the image forming sections Pa to Pd will be described. Around and under the photosensitive drums 1*a* to 1*d*, there are provided charging devices 2*a*, 2*b*, 2*c*, and 2*d*, an exposure device 4, developing devices 3*a*, 3*b*, 3*c*, and 3*d*, and cleaning devices 5*a*, 5*b*, 5*c*, and 5*d*.

When image data is entered via the image reading section 20, first, by the charging devices 2*a* to 2*d*, the surfaces of the photosensitive drums 1*a* to 1*d* are electrically charged uniformly, and then by the exposure device 4, a light beam is radiated so that, on the photosensitive drums 1*a* to 1*d*, electrostatic latent images corresponding to the image data are formed. The developing devices 3*a* to 3*d* include developing rollers (developer carriers) arranged opposite the photosensitive drums 1*a* to 1*d*, and are charged with predetermined amounts of two-component toner containing toner of different colors, namely yellow, magenta, cyan, and black, respectively. The toner is fed onto the photosensitive drums 1*a* to 1*d* by the developing rollers, and the toner images corresponding to the electrostatic latent images are formed.

Then, the toner images on the photosensitive drums 1*a* to 1*d* are primarily transferred to the intermediary transfer belt 8. Thereafter, the toner left behind on the surfaces of the photosensitive drums 1*a* to 1*d* is removed by the cleaning devices 5*a* to 5*d*.

The intermediary transfer belt 8 is stretched between a driven roller 12 and a driving roller 13, and when the intermediary transfer belt 8 starts to rotate counter-clockwise as the driving roller 13 rotates, a sheet 26 is conveyed, with predetermined timing, from the pair of registration rollers 14 to a nip portion (secondary transfer nip portion) between the secondary transfer roller 9 and the intermediary transfer belt 8, and at the nip portion, a full-color image is secondarily transferred to the sheet 26.

The sheet 26 is conveyed to the fixing device 7, and while passing a nip portion (fixing nip portion) between a pair of fixing rollers 15, the sheet 26 is heated and pressed so that the toner images are fixed to the surface of the sheet 26, forming a predetermined full-color image. Thereafter, the sheet 26 is distributed between different conveying directions by a branching member 21 arranged at a branch portion in a sheet conveying passage (recording medium conveying passage) 19 so as to be discharged as it is (or after being sent into a two-sided conveying passage (reversal conveying passage) 23 and undergone two-sided copying) onto a discharge tray 18 via a pair of discharge rollers 24.

Specifically, the sheet conveying passage 19 is configured to branch into two, left and right, paths downstream of a pair of conveying roller 16, one path (the path branching leftward in FIG. 1) leading to the discharge tray 18. The other path (the path branching rightward in FIG. 1) is configured to lead to the two-sided conveying passage 23.

The image forming apparatus 100 according to the present disclosure adopts a structure (rear-face C path) where a substantially C-shaped two-sided conveying passage 23 is provided along the rear face of the apparatus, and a conveying unit 31 that forms part of the two-sided conveying passage 23 is provided so as to be openable relative to the rear face (one side face) of the apparatus main body. Moreover, on the outer face of the conveying unit 31, a cover member 32 is provided so as to be openable relative to the apparatus main body about a bottom end part of the cover member 32.

The conveying unit 31, when closed, faces the intermediary transfer belt 8 and the like to form part of the sheet conveying passage 19 and, when open, retracts from the intermediary transfer belt 8 to leave the sheet conveying passage 19 open. The cover member 32, when closed, faces the conveying unit 31 to form part of the two-sided conveying passage 23 and, when open, retracts from the conveying unit 31 to leave the two-sided conveying passage 23 open.

Figure 2:
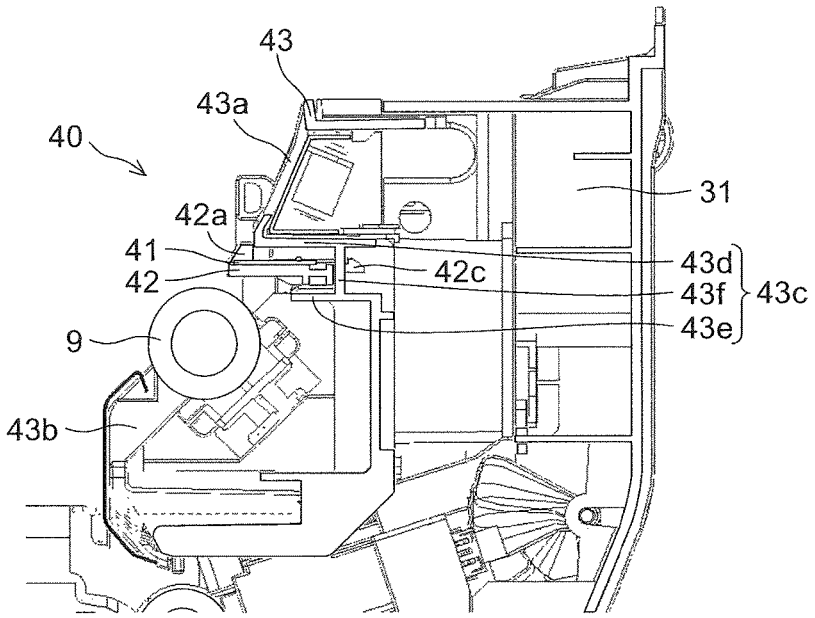
FIG. 2 is a sectional view showing a structure around the destaticizing device according to the one embodiment of the present disclosure.
Figure 3:
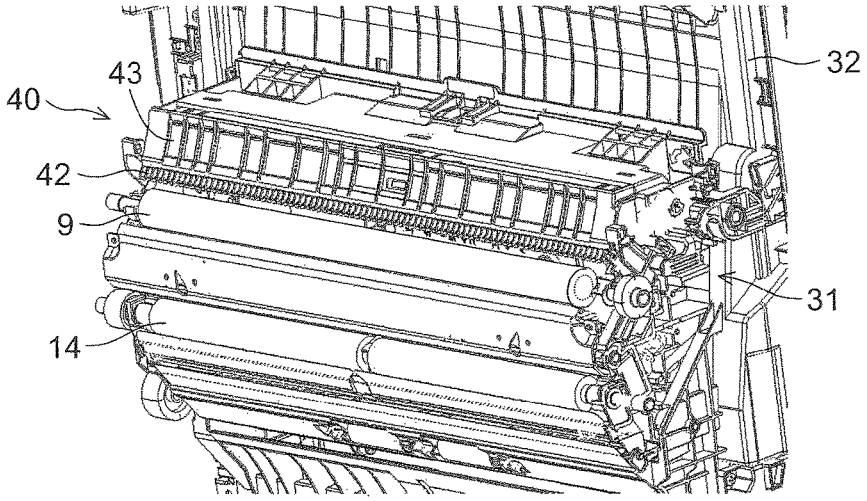
FIG. 3 is a perspective view showing a structure around the destaticizing device according to the one embodiment of the present disclosure.

As shown in FIGS. 2 and 3, downstream of the secondary transfer roller 9 in the sheet conveying direction, the destaticizing device 40 for destaticizing the sheet 26 that has passed through the secondary transfer nip portion is provided. The destaticizing device 40 forms part of the conveying unit 31.

Figure 4:
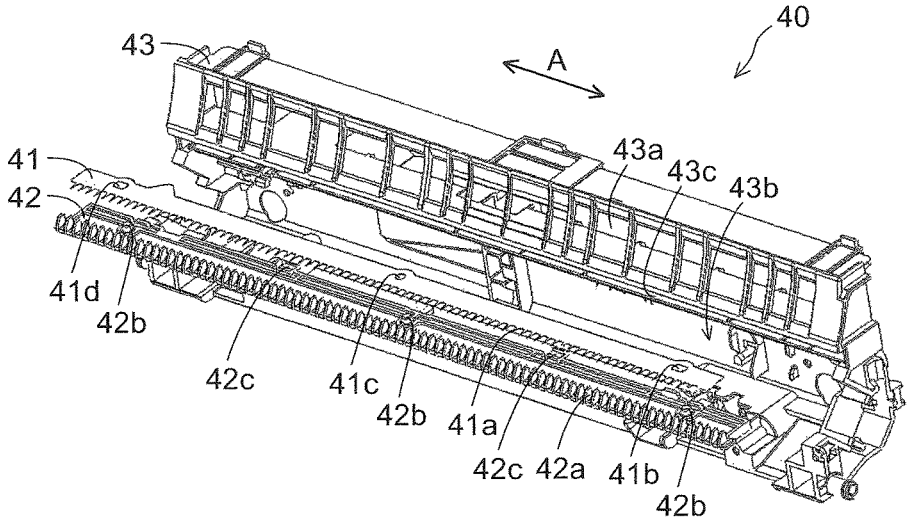
FIG. 4 is an exploded perspective view showing a structure of the destaticizing device according to the one embodiment of the present disclosure.

As shown in FIGS. 2 and 4, the destaticizing device 40 is composed of a destaticizing member 41, which is arranged so as to face the side of the sheet 26 opposite from its side on which the toner images are formed, a holding member 42, which holds the destaticizing member 41, and a body portion 43, to which the holding member 42 is removably attached.

Figure 5:
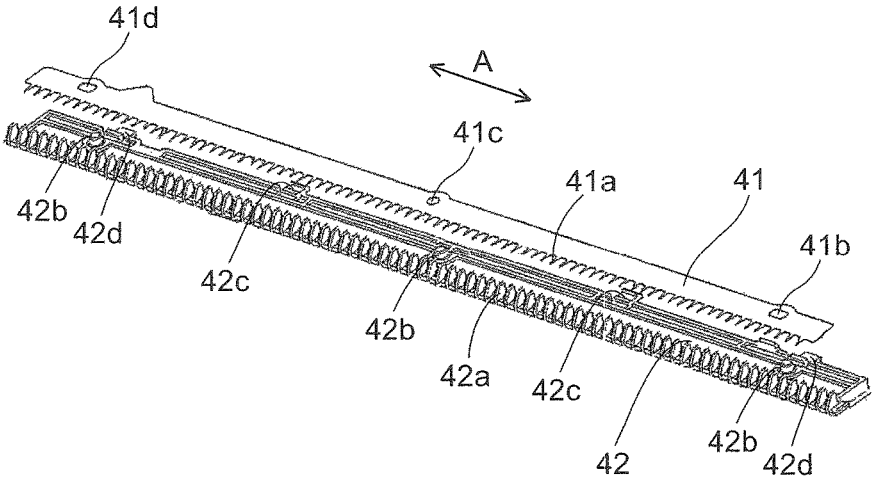
FIG. 5 is an exploded perspective view showing a structure of a destaticizing member and a holding member of the destaticizing device according to the one embodiment of the present disclosure.
Figure 6:
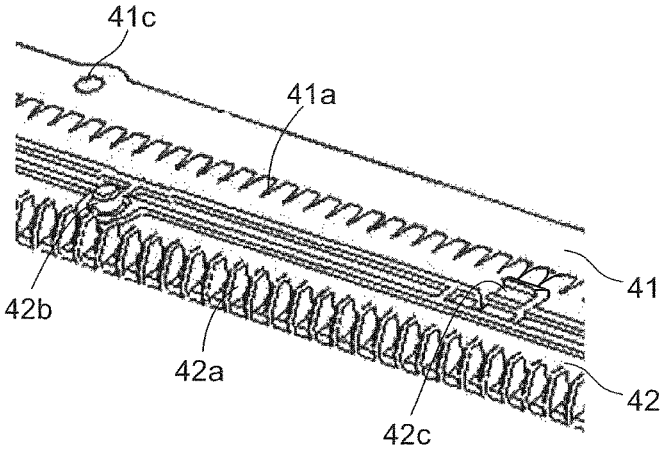
FIG. 6 is a partial enlarged view of FIG. 5.
Figure 7:
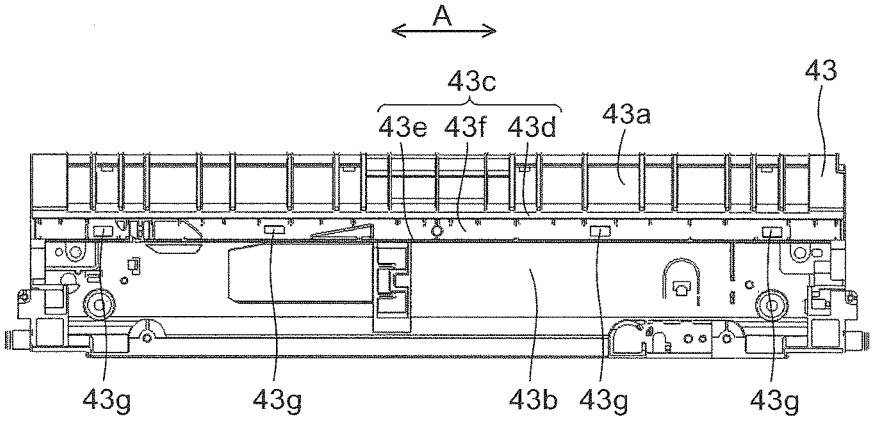
FIG. 7 is a front view showing a structure of a body portion of the destaticizing device according to the one embodiment of the present disclosure.

The destaticizing member 41 is formed by etching a sheet-form metal plate and is electrically conductive. The destaticizing member 41 is formed so as to extend in the sheet width direction (the direction indicated by arrows A, the longitudinal direction) that is perpendicular to the sheet conveying direction. As shown in FIGS. 5 and 6, in an end part of the destaticizing member 41 facing the sheet conveying passage 19, a large number of destaticizing needles 41*a* that protrude toward the sheet conveying passage 19 are formed at a predetermined pitch. In a middle part of the destaticizing member 41 in the arrow-A direction, an attachment hole 41*c* in a perfectly circular shape for positioning is formed, and in one and the other end parts of the destaticizing member 41 in the arrow-A direction, attachment holes 41*b* and 41*d* in an oval shape that extend in the arrow-A direction are formed respectively. To the destaticizing member 41, a predetermined voltage is applied by an unillustrated voltage application portion. When a voltage is applied to the destaticizing member 41, a discharge current passes from the destaticizing needles 41*a* to the sheet 26, which is thus destaticized and is separated from the secondary transfer roller 9.

The holding member 42 is made of resin, and is formed so as to extend in the arrow-A direction. In an end part of the holding member 42 facing the sheet conveying passage 19, a plurality of guide ribs 42*a* for guiding the sheet 26 are formed, each in an erect arc shape, at the same pitch as the destaticizing needles 41*a*. With the destaticizing member 41 attached to the holding member 42, the destaticizing needles 41*a* are located between adjacent ones of the guide ribs 42*a* such that the guide ribs 42*a* and the destaticizing needles 41*a* are located alternately. As seen from the arrow-A direction, the tip ends of the destaticizing needles 41*a* are located so as to be slightly retracted (rightward in FIG. 2) from the sheet guide plane of the guide ribs 42*a*, and make no contact with the sheet 26.

On the top face of the holding member 42, three bosses 42*b* that are inserted in the attachment holes 41*b* to 41*d* in the destaticizing member 41 respectively are formed. The bosses 42*b* are formed in a substantially cylindrical shape protruding upward.

In an end part of the holding member 42 opposite from the sheet conveying passage 19, a plurality of (here, two) engaging claws (engaging portions) 42*c* in a snap-fit shape that protrude away from the sheet conveying passage 19 and a plurality of (here, two) positioning projections (engaging portions) 42*d* that protrude away from the sheet conveying passage 19 and that are arranged so as to sandwich the engaging claws 42*c* are formed along the arrow-A direction.

As shown in FIGS. 2 and 4, in an upper part of the body portion 43 (a part downstream of the destaticizing member 41 in the sheet conveying direction), a conveying guide portion 43*a* having a plurality of ribs for guiding the sheet 26 is formed. The conveying guide portion 43*a* forms part of the sheet conveying passage 19.

In a lower part of the body portion 43 (a part upstream of the destaticizing member 41 in the sheet conveying direction), a roller holding portion 43*b* for holding the secondary transfer roller 9 is formed.

Between the conveying guide portion 43*a* and the roller holding portion 43*b* of the body portion 43, an attachment recess 43*c* that is open toward the sheet conveying passage 19 and in which the holding member 42 is fitted is formed. The attachment recess 43*c* is formed to have a C-shaped cross section as seen from the arrow-A direction, and has a top face portion 43*d*, a bottom face portion 43*e*, and a wall portion 43*f*. The gap between the top face portion 43*d* and the bottom face portion 43*e* is increasingly large from one end part (right end part in FIG. 7) to the other end part (left end part in FIG. 7) of the attachment recess 43*c* in the arrow-A direction. Accordingly, with the destaticizing member 41 and the holding member 42 fitted in the attachment recess 43*c*, the gap between the destaticizing member 41 and the top face portion 43*d* of the attachment recess 43*c* is increasing large from one end part to the other end part of the attachment recess 43*c*.

In the wall portion 43*f* of the attachment recess 43*c*, a plurality of (here, four) engaged portions 43*g* are formed to correspond to the engaging claws 42*c* and the positioning projections 42*d* on the holding member 42. The engaged portions 43*g* are formed as through-holes so that the engaging claws 42*c* and the positioning projections 42*d* can be inserted in them respectively.

When the destaticizing device 40 according to the embodiment is assembled, the destaticizing member 41 is placed on the holding member 42, and the bosses 42*b* on the holding member 42 are inserted in the attachment holes 41*b* to 41*d* in the destaticizing member 41. In this state, the destaticizing member 41 and the holding member 42 are inserted into the attachment recess 43*c* in the body portion 43.

Here, one end part (right end part in FIG. 7) of the destaticizing member 41 and the holding member 42 is inserted into the attachment recess 43*c* before the other end part (left end part in FIG. 7) is. When the destaticizing member 41 and the holding member 42 are fitted into the attachment recess 43*c*, undulation (sag) develops in the destaticizing member 41. Owing to the gap between the destaticizing member 41 and the attachment recess 43*c* being increasingly large from one end part to the other end part of the attachment recess 43*c*, the undulation (sag) that develops in the destaticizing member 41 relaxes toward the other end part where the gap is larger, and thus the undulation (sag) that develops in the destaticizing member 41 is suppressed.

Then, the positioning projections 42*d* on the holding member 42 are inserted into the engaged portions 43*g* in the attachment recess 43*c* and the engaging claws 42*c* are inserted into the engaged portions 43*g*, and this completes the assembly of the destaticizing device 40.

On the other hand, when the destaticizing device 40 is disassembled, the engaging claws 42*c* on the holding member 42 are elastically deformed to disengage from the engaged portions 43*g*, and the holding member 42 and the destaticizing member 41 are pulled out of the attachment recess 43*c*. Then, the bosses 42*b* on the holding member 42 are extracted out of the attachment holes 41*b* to 41*d* in the destaticizing member 41, and this completes the disassembly of the destaticizing device 40.

In the embodiment, as described above, the destaticizing member 41 has, for attachment to the holding member 42, attachment holes 41*b* to 41*d*, and the holding member 42 has a plurality of bosses 42*b* to be inserted in the attachment holes 41*b* to 41*d* respectively and engaging claws 42*c* with a snap-fit shape for attachment to the body portion 43, and the body portion 43 has engaged portions 43*g* with which the engaging claws 42*c* are to be engaged. Thus, after the bosses 42*b* on the holding member 42 are inserted in the attachment holes 41*b* to 41*d* in the destaticizing member 41, by engaging the engaging claws 42*c* on the holding member 42 with the engaged portions 43*g* in the body portion 43, the destaticizing member 41 and the holding member 42 can be attached to the body portion 43 easily. This helps improve the ease of assembly of the destaticizing device 40.

The engaging claws 42*c* are formed in a snap-fit shape, and thus by elastically deforming the engaging claws 42*c*, the holding member 42 and the destaticizing member 41 can be removed from the body portion 43 easily. Then, by extracting the bosses 42*b* on the holding member 42 from the attachment holes 41*b* to 41*d* in the destaticizing member 41, the destaticizing member 41 can be removed from the holding member 42 easily. This helps easily improve the ease of disassembly of the destaticizing device 40.

As described above, in a middle part of the destaticizing member 41 in the arrow-A direction, an attachment hole 41*c* in a perfectly circular shape is provided, and in opposite end parts of the destaticizing member 41 in the arrow-A direction, attachment holes 41*b* and 41*d* in an oval shape are provided. Thus, with the attachment hole 41*c*, the destaticizing member 41 can be positioned relative to the holding member 42, and with the attachment holes 41*b* and 41*d*, the destaticizing member 41 can be prevented from rotating about the attachment hole 41*c*.

As described above, the gap between the destaticizing member 41 and the fitting recess 43*c* in the thickness direction of the destaticizing member 41 is increasingly large from one end part to the other end part of the attachment recess 43*c*. Thus, when the destaticizing member 41 and the holding member 42 are fitted in the attachment recess 43*c* in the body portion 43, the undulation (sag) that develops in the destaticizing member 41 can relax toward the other end part where the gap is larger, and this helps suppress undulation (sag) in the destaticizing member 41.

As described above, in an end part of the holding member 42 opposite from the sheet conveying passage 19, engaging claws 42*c* are formed so as to protrude away from the sheet conveying passage 19, and in the wall portion 43*f* of the attachment recess 43*c* in the body portion 43, engaged portions 43*g* in which the engaging claws 42*c* are inserted are formed. Thus, by sliding the holding member 42 in the direction pointing from the sheet conveying passage 19 to the engaged portions 43*g*, the engaging claws 42*c* on the holding member 42 are inserted into and engage with the engaged portions 43*g*, and thus the holding member 42 can be attached to the body portion 43 easily.

The embodiment disclosed herein should be considered in every aspect illustrative and not restrictive. The scope of the present disclosure is defined not by the description of the embodiment given above but by the appended claims, and encompasses any modifications made in a sense and scope equivalent to those of the claims.

For example, although the above description deals with an example where the present disclosure is applied to a tandem-type color copier as shown in FIG. 1, this is not meant to limit the application of the present disclosure. Needless to say, the present disclosure find application in a variety of image forming apparatuses incorporating a destaticizing device including a destaticizing member and a holding member for holding it, examples of such image forming apparatuses including monochrome copiers, color printers, monochrome printers, and facsimile machines.

Although the above description deals with a destaticizing device 40 that destaticizes a sheet 26 that has passed through a transfer nip portion formed by a intermediary transfer belt 8 and a secondary transfer roller 9, this is not meant to limit the application of the present disclosure. For example, the present disclosure finds application also in destaticizing devices for destaticizing a sheet that has passed through a transfer nip portion formed by a photosensitive drum (image carrier) and a transfer roller (transferring member).

What is claimed is:

1. A destaticizing device for destaticizing a recording medium that has passed through a transfer nip portion formed by an image carrier that carries a toner image and a transferring member that lies in contact with the image carrier, comprising:

a destaticizing member arranged to face a side of the recording medium opposite from a side thereof to which the toner image is transferred, the destaticizing member having a plurality of destaticizing needles protruding toward the recording medium;

a holding member holding the destaticizing member; and a body portion having the holding member removably attached thereto downstream of the destaticizing member in a recording medium conveying direction, wherein the destaticizing member has a plurality of attachment holes for attachment to the holding member, the holding member having a plurality of bosses inserted in the plurality of attachment holes respectively and an engaging claw in a snap-fit shape for attachment to the body portion, the body portion has an engaged portion with which the engaging claw is engaged, the destaticizing member is formed to extend in a direction perpendicular to the recording medium conveying direction, the plurality of attachment holes comprises an attachment hole in a perfectly circular shape that is provided in a middle part of the destaticizing member in a longitudinal direction thereof and an attachment hole in an oval shape that is provided in either end part of the destaticizing member in the longitudinal direction thereof and that extends in the longitudinal direction, the body portion has a conveying guide portion guiding the recording medium downstream of the destaticizing member in the recording medium conveying direction, in a part of the body portion upstream of the conveying guide portion of the body portion in the recording medium conveying direction, an attachment recess that is open toward a recording medium conveying passage and in which the holding member is fitted is provided, and a gap between the destaticizing member and the attachment recess in a thickness direction of the destaticizing member is increasingly large from one end part to another end part of the attachment recess in a longitudinal direction thereof.

2. The destaticizing device of claim 1, wherein in an end part of the holding member facing a recording medium conveying passage, a plurality of guide ribs for guiding the recording medium is formed, in an end part of the holding member opposite from the recording medium conveying passage, a plurality of engaging portions, including at least one of the engaging claw, are formed along a longitudinal direction so as to protrude away from the recording medium conveying passage, and in a wall portion of the body portion opposite from the recording medium conveying passage, a plurality of the engaged portions are formed as through-holes so that the engaging portions are inserted in the engaged portions.

3. An image forming apparatus, comprising:

the destaticizing device of claim 1; and the image carrier and the transferring member which form the transfer nip portion through which the recording medium to be destaticized by the destaticizing device passes.

* * * * *